United States Patent [19]

Gaule et al.

[11] Patent Number: 4,674,557

[45] Date of Patent: Jun. 23, 1987

[54] REGULATION OF THE THICKNESS OF ELECTROMAGNETICALLY CAST THIN STRIP

[75] Inventors: Gerhart K. Gaule, Elberon, N.J.; John C. Yarwood, Madison, Conn.; Gary L. Ungarean, Woodbridge, Conn.; Derek E. Tyler, Cheshire, Conn.

[73] Assignee: Olin Corporation, New Haven, Conn.

[21] Appl. No.: 854,933

[22] Filed: Apr. 23, 1986

Related U.S. Application Data

[63] Continuation of Ser. No. 590,672, Mar. 9, 1984, abandoned.

[51] Int. Cl.[4] ..... B22D 27/02

[52] U.S. Cl. ..... 164/467; 164/503

[58] Field of Search ..... 164/467, 503, 147.1, 164/498

[56] References Cited

U.S. PATENT DOCUMENTS 3,467,166 9/1969 Getselev et al. .
4,161,206 7/1979 Yarwood et al. .
4,353,408 10/1982 Pryor .
4,373,571 2/1983 Yarwood et al. .
4,414,285 11/1983 Lowry et al. .
4,419,177 12/1983 Pryor et al. .
4,469,165 9/1984 Ungarean et al. .

OTHER PUBLICATIONS

Gaule et al., "The Role of Surface Tension in Pulling Single Crystals of Controlled Dimensions", *Metallurgy of Elemental and Compound Semiconductors*, Interscience Publishers, Inc., New York, 1961, pp. 201–226.

Morrison, National Technical Information Service Report PB-248963, "Scale-Up of Program on Continuous Silicon Solar Cells", Sep. 1975.

*Primary Examiner*—Kuang Y. Lin

*Attorney, Agent, or Firm*—Howard M. Cohn; Paul Weinstein

[57] ABSTRACT

A process for electromagnetically casting molten material into a thin strip having a substantially constant thickness. An inductor is provided for electromagnetically shaping the molten material. The material is electromagnetically shaped into a strip having a desired thickness. Variations in the thickness of the molten material are automatically reduced during the shaping step by selecting the frequency of the current applied to the inductor so that the thickness of the strip is about 1.8 to about 2.6 current penetration depth.

5 Claims, 4 Drawing Figures

REGULATION OF THE THICKNESS OF ELECTROMAGNETICALLY CAST THIN STRIP

This application is a continuation, of application Ser. No. 590,672, filed Mar. 19, 1984, now abandoned.

While the invention is subject to a wide range of applications, it is especially suited for use in electromagnetic casting of thin strip material. The process is primarily beneficial for self-regulation of thin strip having a thickness of about 2.2 current penetration depths.

A variety of processes have been developed for forming semi-conductive materials such as silicon into a thin strip shape. Examples of such approaches can be found in National Technical Information Service Report PB-248963 "Scale-Up of Program on Continuous Silicon Solar Cells" by A. D. Morrison, published in September 1975 and a paper entitled "The Role of Surface Tension in Pulling Single Crystals of Controlled Dimensions" by G. K. Gaule et al. from *Metallurgy of Elemental and Compound Semiconductors,* published by Interscience Publishers, Inc., New York in 1961, pages 201–226. The Morrison publication is exemplary of the state of the art with respect to the pulling of strip-type materials from a melt of silicon. The Gaule et al. publication is similarly exemplary and of particular interest insofar as it discloses the use of electromagnetic forces for applying external pressure at the growth interface.

Other examples of forming semi-conductive materials are described below.

In U.S. Pat. No. 4,353,408 to Pryor, an electromagnetic thin strip casting apparatus and process is described which is adapted for forming thin strip castings of a variety of materials including semi-conductive materials such as silicon. This apparatus utilizes a specially-shaped inductor for containing a funnel-shaped pool of molten material into the desired thin strip shape. The process can be carried out continuously or semi-continuously as desired.

U.S. Pat. No. 4,419,177 to Pryor et al. discloses, for example, "a process and apparatus for electromagnetically containing and forming molten material into a desired thin strip shape. At least two inductors are employed which are powered at respectively different frequencies. The frequency of the current applied to the upstream inductor is substantially lower than the frequency applied to the downstream inductor thereby providing improved efficiency and reduced power consumption."

U.S. patent application, Ser. No. 488,848, filed Apr. 26, 1983 (now abandoned) by J. C. Yarwood et al., discloses an apparatus having a first portion for electromagnetically containing and forming molten material into a cross-sectional shape substantially the same as the desired resulting thin strip shape. A second portion receives the molten material in the thin strip shape from the first portion and reduces the bulging in the cross-sectional shape which is due to surface tension. The second portion provides an electromagnetic field having a reduced strength as compared to the strength of the electromagnetic field in the first portion.

A considerable body of art has developed with respect to the use of electromagnetic containment for the purpose of casting metals. Such electromagnetic casting apparatus comprises a three-part mold consisting of a water cooled inductor, a non-magnetic screen, and a manifold for applying cooling water to the resultant casting. Such an apparatus is exemplified in U.S. Pat. No. 3,467,166 to Getselev et al. Containment of the molten metal is achieved without direct contact between the molten metal and any component of the mold. Solidification of the molten metal is achieved by the direct application of water from a cooling manifold to the solidifying shell of the casting. An elaborate discussion of the prior art relating to electromagnetic casting is found in U.S. Pat. No. 4,161,206 to Yarwood et al.

The above cited electromagnetic casting art references and indeed virtually all the literature describing the art refer to containment of molten conductors of "infinite" thickness, i.e. many penetration depths thick. Little information exists on the characteristics of loads such as thin silicon ribbon and its precursor melt which may be only a few penetration depths thick, i.e. $<5\delta$. The present invention discusses such loads and discloses a novel means of containment control available for very thin ribbon casting.

U.S. Pat. No. 4,469,165 by G. L. Ungarean et al. is directed to electromagnetic edge control of thin strip material. The invention is particularly suited to overcome the surface tension effects which occur during the shaping of thin semi-conductor ribbon. Since the minimum thickness of the ribbon is greater than about 4 skin depths of the electric fields generated by coils 18 and 20, the self-regulating containment control of the present invention does not occur.

It is a problem underlying the present invention to provide a process for self-regulation of the thickness of a thin strip being electromagnetically cast.

It is an advantage of the present invention to provide a process for self-regulating the thickness of a molten material strip which obviates one or more of the limitations and disadvantages of the described prior arrangements.

It is a further advantage of the present invention to provide a process for self-regulating the thickness of a molten strip being cast whereby reduction in the variations of the thickness is automatically obtained.

It is a yet further advantage of the present invention to provide a process for self-regulating the shaping of a molten strip which is relatively inexpensive to achieve.

Accordingly, there has been provided a process for electromagnetically casting molten material into a thin strip having a substantially constant thickness. An inductor is provided for electromagnetically shaping the molten material. The material is electromagnetically shaped into a strip having a desired thickness. Variations in the thickness of the molten material are automatically reduced during the shaping step by selecting the frequency of the current applied to the inductor so that the thickness of the strip is equivalent to about 1.8 to about 2.6 times the current penetration depth.

The invention and further developments of the invention are now elucidated by means of the preferred embodiments shown in the drawings.

Figure 1:
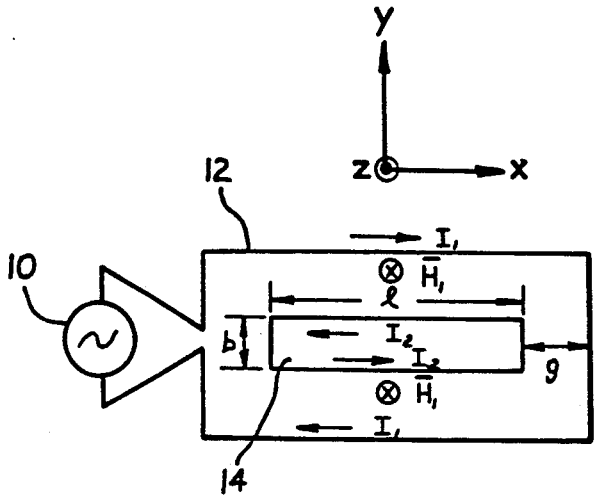
FIG. 1 is a diagrammatic view of an electromagnetic casting device in accordance with the present invention.

FIG. 1 illustrates a top view of a typical electromagnetic containment apparatus. It consists of a power supply 10, containment inductor 12 and a liquid ribbon 14 with length l and thickness b. Flowing through the containment inductor is a current $I_1$ alternating at a frequency of $\omega$ radians per second. As described by Maxwell's Law, the current, $I_1$, in inductor 10 generates a magnetic field, $\overline{H}_1$, which alternates at the same frequency as $I_1$.

As the magnetic field, $\overline{H}_1$, i mpinges on the load 14, it induces a circulating current, $I_2$, which is antiparallel with respect to Il. Note also that $I_1$ and $I_2$ are of opposite polarity with respect to a longitudinal centerline through the load. That is, an inductor current flowing in the positive (negative) x direction produces a magnetic field orientated in the negative z direction inside the inductor and induces a reactionary current in the load whose orientation on the surface is in the negative (positive) x direction. The skin depth or penetration depth $\delta$ of the induced current in the material is a function of the frequency of the inductor current and the resistivity of the material as set forth in U.S. Pat. No. 4,161,206 to Yarwood et al.

On a macro scale, when the material thickness, b, is much greater than $\delta$, there is no contribution to the magnetic field impinging on the melt near one boundary from the magnetic field at the other opposite boundary. Accordingly, the containment pressure is proportional to the vector cross product of the magnetic field, $\overline{H}$HD 1, and the induced current, $I_2$, as seen in FIG. 1.

$$P \alpha \overline{H}_1 \times I_2$$

Figure 2:
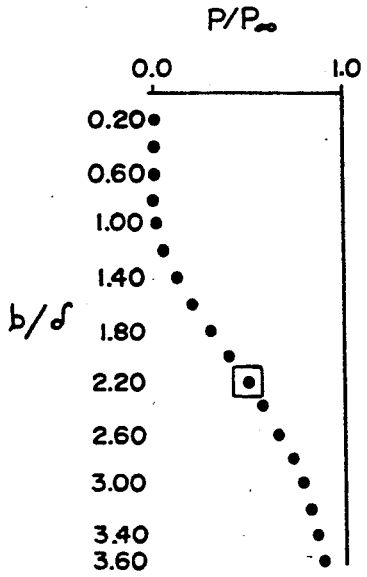
FIG. 2 is a graph of relative containment pressure for various values of $b/\delta$.
Figure 3:
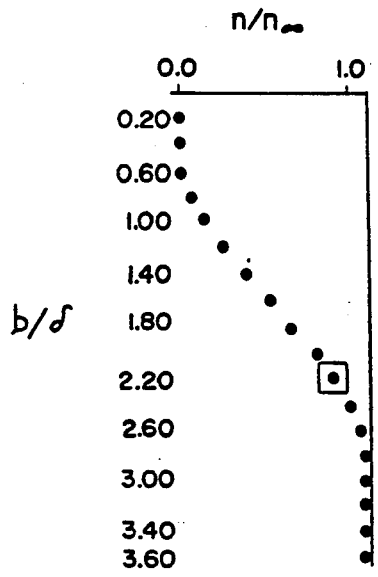
FIG. 3 is a graph of the relative real power consumed by the load for various values of $b/\delta$.
Figure 4:
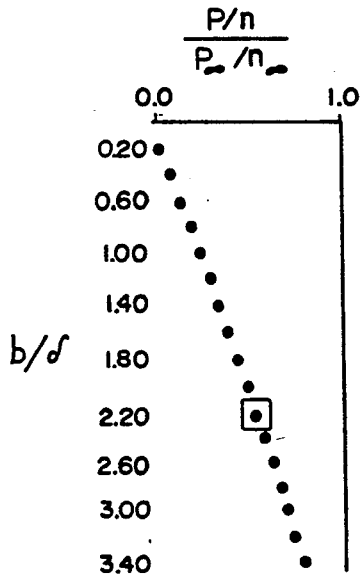
FIG. 4 is a graph of the pressure to power ratio for various values of $b/\delta$.

On a micro scale with b being less than about 5 electromagnetic penetration depths, the magnetic fields induced from opposite boundaries of the melt interfere with each other and effect the induced current in the melt. That is, when the magnetic field generated on one side of the melt reaches the opposite side of the melt, it adds to the second magnetic field entering the second side of the melt. Formulas for the magnetic fields on either side of one metallic boundary, and for currents in the metal have been derived through the application of Maxwell's Laws governing electromagnetics. The results of these formulas, modified to apply to two closely spaced boundaries or surfaces, are shown in the graphs of FIGS. 2–4. The three graphs are plotted against values of $b/\delta$ where b is the total material thickness and $\delta$ is the skin depth of the material at the frequency of operation.

The graph of FIG. 2 is a plot of the relative containment pressure $P/P_\infty$ for various values of $b/\delta$ where P is the containment pressure acting on a body of b thickness and $P_\infty$ is the pressure acting upon a body of infinite thickness. The graph of FIG. 3 is a plot of the relative real power $n/n_\infty$ consumed by the load for the values of $b/\delta$ plotted in FIG. 2. Note that n is the power consumed to support a melt of b thickness and $n_\infty$ is the power consumed to support a melt of infinite thickness. The graph of FIG. 4 is a plot of the pressure to power ratio $P/_n/P_\infty/n_\infty$ which is a measure of efficiency.

Through the differentiation of the pressure containment curve of FIG. 2, i.e. taking the first derivative, it is indicated that the pressure increases most steeply with the ratio of $b/\delta$ in the vicinity of 2.2. This means that the ratio where $b/\delta$ is approximately equal to 2.2, optimum self-regulation of b, the melt thickness, can be achieved with constant inductor current. When the thickness begins to increase, more magnetic field will be absorbed within the melt resulting in an increase in the induced current and containment pressure. Further, the containment pressure will increase at a faster rate than the size increase. Likewise, when the thickness begins to decrease, the containment pressure will decrease for the same reason at a faster rate than the size decrease. In either case, as the size begins to change, it will be counteracted by a change in the containment pressure causing the thickness to move back to the optimum point of self-control, i.e. where $b/\delta$ is 2.2. Due to the nonlinear relationship of $b/\delta$ for $P/_{P_\infty}$, the range of sensitivity required for self-regulation for $b/\delta$ is between about 1.8 to about 2.6. More preferably, the range is between about 2.0 to about 2.4. Most preferably, $b/\delta$ is about 2.2. At that point, the physical thickness of the material is matched to the skin depth so that maximum sensitivity is achieved. This matching may be accomplished through the selection of the operating frequency of the inductor current so that the electrical thickness of the melt is about 2.2 $\delta$.

This self-regulation represents a considerable advantage over state of the art regulation such as taught in U.S. Pat. No. 4,161,206. In that patent, complex circuitry is required to develop the required sensitivity to thickness variations in very thin materials. Also, state of the art regulation guarantees only average thickness control; whereas, the control taught in the present invention provides some local thickness regulation as the fields are regulated on a local basis.

The self-regulation of the present invention does come at the expense of inefficient power utilization as indicated by the graph in FIG. 4. The curve of efficiency at $b/\delta$ equals 2.2 is approximately 54%.

The present invention is particularly adapted for casting semi-conductive materials such as silicon or germanium having very thin cross sections. However, the present invention may also be adapted for use with other metals, alloys and other metalloids as desired.

The patents and references set forth in this application are intended to be incorporated by reference herein.

It is apparent that there has been provided in accordance with this invention a regulation of the thickness of electromagnetically cast thin strip which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. The process of electromagnetically casting molten material into a thin strip having a substantially constant thickness, comprising the steps of:

providing a single inductor disposed about the molten material;

applying a substantially constant current to said inductor for electromagnetically shaping molten material into a strip having a desired thickness, said step of applying said constant current comprising:

providing a self-regulating condition comprising applying said current at a desired current frequency which is selected so that about 2.2 to about 2.6 current penetration depths of induced current in said molten material is equal to the desired thickness of the strip.

2. The process of claim 1 further including the step of selecting said current frequency so that about 2.2 current penetration depths of induced current in said molten material equals the desired thickness of the strip.

3. The process of claim 2 further including the step of selecting said material from the group consisting of metals, metal alloys and metalloids.

4. The process of claim 3 inclusing the step of selecting said materials from a metalloid.

5. The process of claim 4 further including the step of selecting said metalloid of silicon.

* * * * *